US005725707A

United States Patent [19]

Koon et al.

[11] Patent Number: 5,725,707

[45] Date of Patent: Mar. 10, 1998

[54] ENHANCED CONDUCTIVE JOINTS FROM FIBER FLOCKING

[75] Inventors: Robert W. Koon, Palos Verdes; Thomas E. Steelman, Torrance, both of Calif.

[73] Assignee: Northrop Grumman Corporation, Los Angeles, Calif.

[21] Appl. No.: 419,579

[22] Filed: Apr. 10, 1995

[51] Int. Cl.[6] ..... H01B 01/04; H01R 04/58

[52] U.S. Cl. ..... 156/157; 156/273.1; 156/276; 156/304.5; 174/74 R; 174/261; 427/122; 427/206; 427/463; 439/290; 29/825; 29/869; 29/872

[58] Field of Search ..... 156/292, 72, 273.1, 156/276, 157, 304.5; 174/74 R, 261; 439/289, 290, 291; 427/122, 206, 463; 29/868, 869, 872, 825; 403/DIG. 1

[56] References Cited

U.S. PATENT DOCUMENTS

| | | | |
|---|---|---|---|
| 4,857,377 | 8/1989 | Daimon et al. | 428/90 |
| 4,945,016 | 7/1990 | Murachi | 524/81 |
| 4,997,993 | 3/1991 | Halversen | 174/35 R |
| 5,115,104 | 5/1992 | Bunyan | 174/35 G |
| 5,185,402 | 2/1993 | Fleming et al. | 525/130 |
| 5,316,839 | 5/1994 | Kato et al. | 428/285 |
| 5,506,293 | 4/1996 | Steelman et al. | 524/496 |

OTHER PUBLICATIONS

Bolgen, "Flocking Technology", *Journal of Coated Fabrics*, vol. 21 –Oct. 1991, p. 123 et seq.

Potente and Gabler, "A New Method for Flocking Plastics", *Polymer Engineering Reviews*, vol. I, No. 3, 1981, p. 249 et seq.

*Primary Examiner*—Francis Lorin

*Attorney, Agent, or Firm*—Terry J. Anderson; Karl J. Hoch, Jr.

[57] ABSTRACT

A method and apparatus for providing electrical conductivity between the opposing surface edges of gaps and joints in composite and metallic structures comprises fiber flocking a first and second set of conductive fibers in a direction normal to the surface edge of each side of the gap or joint. The first and second set of conductive fibers are positioned such that the conductive fibers interdigitate with respect to each other providing a compliant electrically conductive path between the opposing surface edges of the structural gaps and joints. After assembly, the defined joint or gap containing the interdigitated sets of carbon fibers may be filled with a polymer material or materials which constitute state of the art matrix materials used for conductive joints. Applications for this technology include electromagnetic shielding and low observables.

28 Claims, 4 Drawing Sheets

| *Listed Material* | *Supplier* |
|---|---|
| *P120* | *Amoco Performance Products* |
| *AS4* | *Hercules* |
| *K1100* | *Amoco Performance Products* |
| *9703 Transfer Tape* | *3M* |

| Butt Joint Material | Resistance (Ω) |
|---|---|
| Silicone | $\sim 10^{9}$ |
| Silicone + Random Carbon Fiber | $\sim 10^{6}$ |
| Silicone + Cu Particulate | $\sim 10^{3}$ |
| Silicone + Flocked Carbon Fiber | $\sim 10^{0}$ |
| Silicone + Cu Particulate + Flocked Carbon Fiber | $\sim 10^{-1}$ |

FIG. 6

| Lap Joint Material | Resistance (Ω) |
|---|---|
| 3M 9703 Transfer Tape, 2 Layers | 30 |
| 0.004" Aramid Felt + P120 Flock | 5 |
| 0.01" Carbon Felt + P120 Flock | 1 |
| 5 Min Epoxy + P120 Flock | 0.06 |

FIG. 7

| Fiber | Thermal Conductivity (W/m-K) |
|---|---|
| (Epoxy) | 0.2 |
| AS4 | 1 |
| P120 | 12 |
| K1100 | 17.3 |

FIG. 8

ENHANCED CONDUCTIVE JOINTS FROM FIBER FLOCKING

BACKGROUND OF THE INVENTION

The present invention relates to electromagnetic interference (EMI) shielding techniques. More particularly, the invention relates to EMI shielding of the structural and non-structural joints present upon assembly of aircraft and ships by use of an improved conductive fiber flocking technology. In addition, the present invention relates to improved conductive joint technology for low observables applications.

In the design and manufacture of state-of-the art composite aircraft and shipboard structures, special attention must be given to protect the sensitive electronic equipment located within these structures from the effects of external electromagnetic fields. More specifically, the structural and non-structural joints located throughout these structures are particularly vulnerable in allowing the leakage of external electromagnetic fields to reach and interfere with the performance of the electronic equipment housed within.

To accomplish the objective of sealing the structural and non-structural joints, it is known that filling the joint with a conductive putty prevents the external electromagnetic fields from leaking through the structure and thereby shielding the electronic equipment from the effects of electromagnetic radiation.

However, a problem arises in that the putty has a tendency to fail after cure by developing cracks in response to the severe environmental conditions that aircraft and ships are subjected to during operation, thereby providing leakage points and allowing the penetration of outside external electromagnetic fields to reach the inner housed electronic equipment. In addition, more severe electromagnetic environments are anticipated to be encountered by next generation aircraft and ships. State-of-the-art techniques and materials designed to protect these systems from such electromagnetic interference will likely prove unable to achieve the levels of protection required.

Compliant conductive gaps are also required in low observable vehicles. Known materials solutions suffer from the same problems that affect the materials used for EMI Shielding, namely fatigue resistance, cure times and health and safety issues.

Therefore, a need exists to provide an inexpensive and high performance means of providing enhanced conductivity across a polymer joint that improves the overall external EMI shielding and/or low observable characteristics of advanced aircraft and shipboard composite and metallic structures.

The subject invention herein solves all of these problems in a new and unique manner which has not been part of the art previously. Some related patents are described below:

U.S. Pat. No. 4,997,993 issued to G. V. Halversen on Mar. 5, 1991

This patent describes a seal for providing electrical continuity across discontinuities in the outer skins of aircraft. The seal comprises a plurality of conductive brushes mounted on opposite sides of the discontinuity with the bristles of the brushes movable between a retracted and extended position in which the bristles interdigitate to form a continuous conducting surface.

U.S. Pat No. 5,115,104 issued to M. A. Bunyan on May 19, 1992

This patent is directed to an inexpensive, lightweight shielding gasket. The shielding gasket comprises a conductive or non-conductive resilient core, the surface of which is rendered electrically conductive by flocking with conductive fibers. The invention further provides a method of selectively flocking selected areas of the surface of the core with conductive fibers.

SUMMARY OF THE INVENTION

The present invention is directed to a method and apparatus using an improved fiber flocking technique which provides electrical conductivity across the opposing surface edges of gaps and joints located throughout an aircraft and ship's composite and metallic structure after assembly. Additionally, the improved fiber flocking technique may be used to provide conductive gap joints in already assembled structures.

The method and apparatus comprises flocking conductive carbon fibers along each surface edge of the structural panels which will form a gap or joint when assembled, such that the carbon fibers are aligned in a direction normal to the surface edge of each side of the gap or joint. The invention further comprises upon assembly of the panel structures interdigitating each carbon fiber on a first surface edge with the opposing carbon fiber on a second surface edge thereby providing an overall compliant electrically conductive joint design. After the flocking process is complete, the defined joint or gap containing the interdigitated sets of carbon fibers may be filled with a polymer material which constitute state of the art matrix materials used for conductive joints.

An object of the present invention is to provide a method that provides improved electrical conductivity and structural integrity within the gaps and joints formed by adjoining structural panels comprising the exterior of ships and aircraft.

A further object of the present invention is to provide a method for forming an electromagnetic seal across the structural gaps and joints of composite aircraft and shipboard structures that is relatively easy, practical and inexpensive to apply.

Still another object of the present invention is to provide a method to achieve conductivity across structural gaps and joints of composite aircraft and shipboard structures which reduces the susceptibility to mechanical and thermal fatigue failures associated with the structural gaps and joints.

Still another object of the present invention is to provide a method and apparatus for sealing structural gaps and joints which improves the electrical conductivity and is highly corrosion resistant in use.

Accordingly, it is an objective of the present invention to provide a method and apparatus using conductive fibers with and without polymer materials that enhances the electrical conductivity across structural gaps and joints of composite aircraft and shipboard structures. The improvements afforded by this method will be set forth throughout the following description, claims and accompanying drawings.

BRIEF DESCRIPTION OF THE DRAWINGS

The above as well as other advantages of the present invention will become readily apparent to those skilled in the art from the following description of the preferred embodiments when considered in the light of the accompanying drawings in which:

FIG. 6 is a table illustrating for butt joints the reduction in resistance by use of the method and apparatus of the present invention over prior art techniques;

FIG. 7 is a table illustrating for lap joints the reduction in resistance by use of the method and apparatus of the present invention over prior art techniques; and FIG. 8 is a table illustrating the improvement in thermal conductivity by use of the method and apparatus of the present invention over prior art techniques.

DESCRIPTION OF THE PREFERRED EMBODIMENTS

Figure 1:
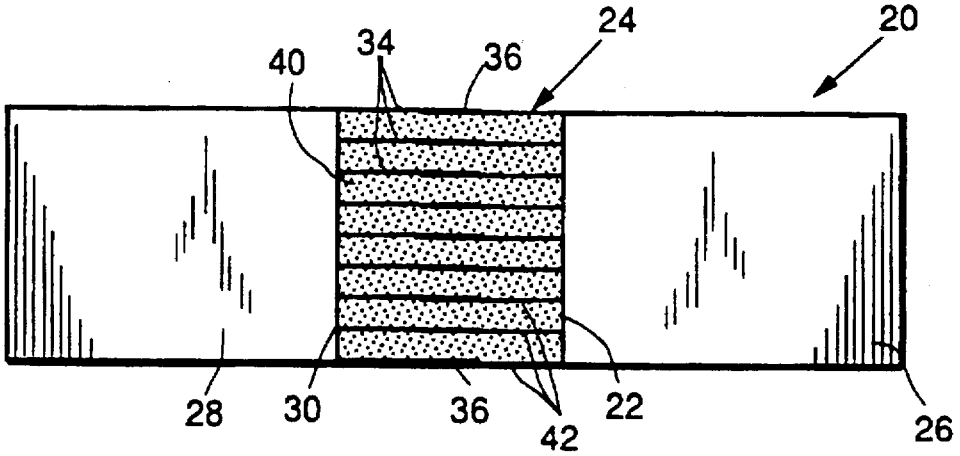
FIG. 1 is a cross-sectional side view of an EMI shielded butt joint according to the method and apparatus of the present invention.

Referring now to the drawings wherein like reference numerals refer to like and corresponding parts throughout, the conductive joint method and apparatus of the present invention is generally indicated by numeral 20. Referring now to FIG. 1, the conductive joint method and apparatus 20 of the invention is shown in use to permanently seal a structural butt gap or butt joint 24 that exists between opposing structural panels 26 and 28 respectively, comprising the exterior surface (not shown) of an aircraft or ship.

The term "EMI Shielding" as used herein refers to the process used to protect electronic equipment such that it is shielded from receiving external electromagnetic radiation. It is known in the art that electronic circuitry contained within electronic equipment is often vulnerable in operation if there are radio frequency waves present which may electromagnetically couple to the electronics resulting in a variety of undesirable electrical anomalies. The problems associated with this type of physical phenomenon is commonly referred to as "electromagnetic interference" or "EMI".

The term "low observables" as used herein refers to the backscatter characteristics of aircraft and shipboard structures. It is known in the art that electrical discontinuities brought on by untreated gaps or joints are vulnerable to undesirable backscatter (or reflection) characteristics. Treating the gap with conductive fillers is necessary in many cases to achieve desired reflection loss characteristics.

The term "flock" as used herein refers to the process of flock coating, whereby a surface is coated with a tacky adhesive and then a coating of natural and/or synthetic fibers are electrostatically applied. The tacky adhesive may be fast drying or have a curing system both of which depend upon the production requirements of the aircraft and ships. Therefore, a "flocked" surface is one which has a coating of fiber materials applied to a surface by a flock coating process.

Figure 2:
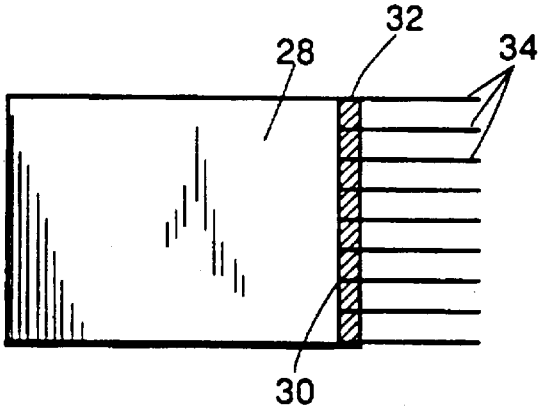
FIG. 2 is an enlarged view of a selected area of FIG. 1, illustrating details of the flocked surface according to the method and apparatus of the present invention.

Before final assembly of the structural panels 26 and 28 which form the exterior of state of the art aircraft and ships (not shown), the surface edges 22 and 30 respectively, are treated according to the method of the present invention. In the preferred embodiment, a surface edge 30 of a structural panel 28 is first coated with a high-tack adhesive 32, as shown in FIG. 2. The high-tack adhesive 32 used to coat surface edge 30 may be selected from a wide range of adhesives based upon performance requirements and manufacturing constraints for each individual application. Primarily, the flocking adhesive 32 is selected for high electrical conductivity, relatively quick curing time, and good low temperature characteristics with mechanical strength being a secondary consideration.

After the high-tack adhesive 32 has been evenly applied to edge surface 30 of structural panel 28, a plurality of conductive fibers 34 are applied to the adhesive coated surface edge 30. The preferred method of applying the conductive fibers 34 to adhesive coated surface edge 30 is by application of electrostatic deposition by any known means used in the art of electrostatic flocking. Additionally, if the "standard" textile technique for electrostatic flocking is used, some modifications must be made to the equipment used such that the equipment is not electrically shorted when using conductive fibers 34. By use of electrostatic deposition or flocking, the conductive fibers 34 are evenly spaced apart from each other and are positioned normal to the surface edge 30 of structural panel 28.

Figures 4, 5:
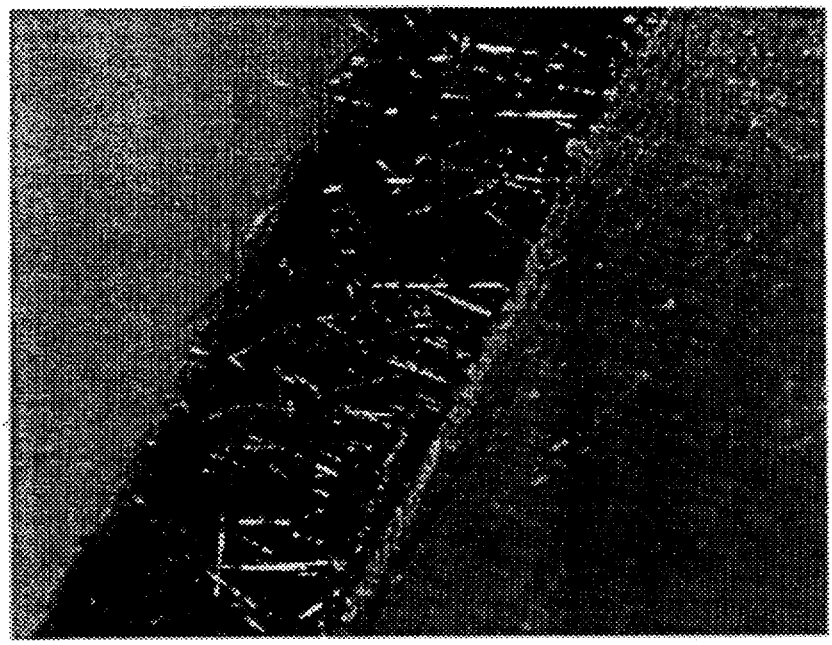
FIG. 4 is a photograph of a plurality of interdigitated conductive fibers at a butt joint edge according to the method and apparatus of the present invention.
FIG. 5 is a table listing materials and their associated suppliers for use in EMI shielding applications.

In the preferred embodiment, conductive carbon fibers 34 are used in the flocking method in accordance with the present invention and are listed and designated in FIG. 5 as P120 and K1100. Conductive carbon fibers 34 are preferred because of their characteristic high electrical conductivity, corrosion resistance and suitability for the flocking method of the present invention. Additionally, it should be understood that any type of conductive fiber such as plated synthetic and natural fibers or metal coated fibers may be used in place of carbon fibers.

P-120 are Thornel® graphite fibers having ultrahigh modulus strands made from a pitch precursor, for use in stiffness-critical applications. Its typical properties and characteristics are listed below.

| Property | U.S. Customary Units |
|---|---|
| Tensile Strength | 325 lb/in$^2$ × 10$^3$ |
| Tensile Modulus | 120 lb/in$^2$ × 10$^5$ |
| Density | 0.079 lb/in$^3$ |
| Filament Diameter | 10μ |
| Elongation at Break | 0.27% |
| Elastic Recovery | 100% |
| Carbon Assay | 99+% |
| Surface Area | .4 m$^2$/g |
| Longitudinal Thermal Conductivity | 370 BTU-ft/hr (ft$^2$) (°F.) |
| Electrical Resistivity | 2.2 ohm-cm × 10$^{-4}$ |
| Longitudinal CTE at 70° F. (21° C.) | −0.8 PPM/°F. |

Typical strand properties are as follows:

| Property | | U.S. Customary Units |
|---|---|---|
| Yield | 1K | 2920 yd/lb |
| | 2K | 1570 yd/lb |
| Denier | 1K | 1530 g/9000 m |
| | 2K | 2850 g/9000 m |
| Twist | 1K | 0.4 tpi |
| | 2K | 0.4 tpi |
| Filaments/ | 1K | 1000 |
| Strand | 2K | 2000 |
| Fiber Area in Yarn | 1K | 12.7 in$^2$ × 10$^{-5}$ |
| Cross Section | 2K | 12 in$^2$ × 10$^{-5}$ |

K-1100 is a Thornel® graphite fiber designed for thermal management applications. Its also ultrahigh longitudinal thermal conductivity is 2–3 times that of copper and 4–5 times that of aluminum. This unique combination of ultra-high modulus, low density and high thermal conductivity has resulted in significant weight savings over traditional materials used in thermal-management applications. K-1100 is constructed as a continuous filament made from a pitch precursor. The fiber properties are as follows:

| Fiber Properties | Range |
|---|---|
| Tensile Strength, $lb/in^2 \times 10^3$ | 350–550 |
| Tensile Modulus, $lb/in^2 \times 10^6$ | 130–145 |
| Density, $Mg/m^3$ | 2.15–2.25 |
| Electrical Resistivity, ohm-cm $\times 10^{-4}$ | 1.1–1.3 |
| Estimated Thermal Conductivity, W/mK | 950–1170 |
| Yield, m/g | 3.13–2.94 |
| Filament/Strand | 2000 |
| Surface Treatment | None or Standard |
| Size | UC320 or UC304 |
| Twist | None |
| Filament Diameter | 10μ |

Thornel® is a registered trademark of Amoco Performance Products, Inc., USA.

Referring now to FIG. 1, the structural panel 28 is installed in a butt joint configuration with a complementing structural panel 26 having a second set of conductive fibers 42 affixed to a surface edge 22 according to the method of the present invention, as described above. The first set of conductive fibers 34 of structural panel 28 are positioned to interdigitate and contact the second set of conductive fibers 42 upon installation thereby providing a constant conducting surface 36 between the first surface edge 30 of structural panel 28 and second surface edge 22 of structural panel 26. Additionally, it may be envisioned that the aforementioned method may be applied to the butt joint 24 after the structural panels 26 and 28 are in place, which results in achieving a conductive gap joint in an already assembled structure, a method heretofore not known in the prior art.

In application, the number and resilience of the conductive fibers 34 and 42 is such that they will conform or bend somewhat to accommodate each other in the interdigitated state, as shown in the photograph of FIG. 4. By way of example but not of limitation, in the interdigitated position the conductive fibers 34 and 42 attached to surface edges 22 and 30 respectively, have a 60 mil overlap across a 100 mil gap 24. However, it should be understood that the extent of the overlap between the conductive fibers 34 does not effect the gap's 24 overall conductivity providing that there is a minimum "overlap within the gap" such that the overlapped conductive fibers 34 and 42 respectively, are in contact with each other.

Additionally, the diameter of the conductive fibers 34 and 42 is likely to have only a minor effect on the aforementioned electrical properties across gap 24. In the preferred embodiment the length of the conductive fibers 34 and 42 respectively, should have an aspect ratio of greater than 100. In use, conductive fibers 34 and 42 having a diameter of approximately 10–15 microns have been applied across a quarter inch butt gap or joint 24 in accordance with the method of the present invention.

Referring now to the measured test data shown in FIG. 6, the prior art technique of filling a structural butt joint 24 completely with a silicone material produces a high electrical resistance value in ohms which results in poor conductivity. Furthermore, the use of random carbon fibers or copper particulate material in association with the silicon filler, while an improvement over use of a silicon filler alone, still measured relatively high values of electrical resistance. However, by aligning the conductive fibers 34 and 42 in accordance with the method of the present invention, a dramatic improvement in the value of resistance was achieved, approximately nine orders of magnitude greater than using a silicone filler alone. Also, the addition of copper particulate material with flocked carbon fiber showed still more improvement in conductivity.

In a second preferred embodiment, after the first and second sets of conductive fibers, 34 and 42 respectively, are placed in the interdigitated position within structural butt gap or butt joint 24, the assembly may be sealed with a polymer filler 40. The use of a polymer filler 40 may be necessary in those applications where fluid resistance, moisture ingress and aerodynamic considerations across a structural butt gap or butt joint 24 are of concern.

The polymer filler 40 may be an off-the-shelf elastomer filler composed of silicon, polythioether, urethane, or the like depending upon cost and performance requirements. It may be envisioned that a conductive polymer filler be used to augment the conductivity across the gap 24, however only a minimal improvement in gap conductivity is likely to be achieved with rather significant sacrifices in the mechanical properties across the gap 24.

In a third preferred embodiment, the polymer filled interlocking fiber assembly is a removable "bead" and therefore has application to on-aircraft or shipboard application for retrofit or repair. In this embodiment, the assembly must be flexible and therefore the polymer filler must be composed of elastomer type materials such as silicon, polythioether or urethane.

Figure 3:
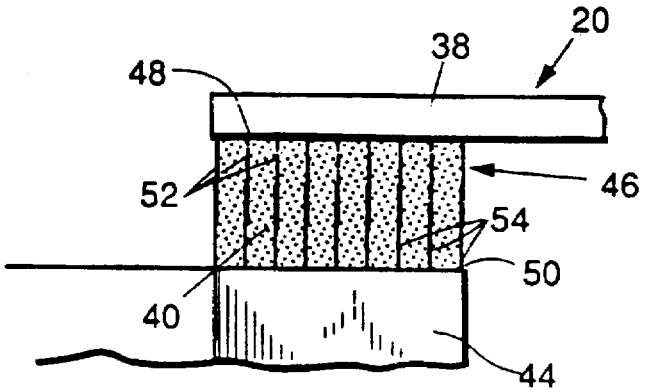
FIG. 3 is a cross-sectional side view of an EMI shielded lap joint according to the method and apparatus of the present invention.

Turning now to FIG. 3, the conductive joint method and apparatus 20 of the present invention is applied to a lap joint configuration 46, wherein a structural panel 38 having surface edge 48 is installed against an opposing complementing structural panel 44 having surface edge 50. In accordance with the above-described method for electrostatic flocking, the surface edges 48 and 50 of structural panels 38 and 44 respectively, are flocked to have a first and second set of conductive fibers 52 and 54 respectively, affixed in a plane normal and positioned and spaced to interdigitate and contact against each other. Once again, the interdigitation and contact of the first and second set of conductive fibers, 52 and 54 respectively, provides a constant conducting surface between the surface edges 48 and 50 respectively, as shown in FIG. 3.

However, unlike structural gap joints 24, the strength drivers in lap joint configurations require lap joints 46 to be sealed with a polymer filler 40. Therefore, a polymer filler 40 must be used to seal the lap joint 46 by filling the space between the first and second set of interdigitated conductive fibers, 52 and 54 respectively, thereby providing the necessary mechanical or strength characteristics. Besides this above-identified difference, the lap joint configuration 46 having interdigitated conductive fibers 52 and 54 respectively, functions substantially as the butt joint configuration 24 having interdigitated conductive fibers 34 and 42 respectively, and the materials necessary for each of the components are the same.

Referring now to the measured test data shown in FIG. 7, the prior art technique of filling a structural lap joint 24 by using two layers of transfer tape produced a high electrical resistance value of 30 ohms translating in poor conductivity. Furthermore, the use of aramid felt and carbon felt material in association with a P120 flock, while an improvement over use of layers of transfer tape, still measured relatively high values of electrical resistance. However, by aligning the conductive fibers 52 and 54 in accordance with the method of the present invention, a dramatic improvement in the value of resistance was achieved as shown by measured values of six hundredths of an ohm, resistance values heretofore not obtained in the prior art.

Referring now to the measured test data shown in FIG. 8, the thermal conductivity of epoxy and several different types of fibers are compared. As shown in FIG. 8, the prior art technique of filling butt and lap joints with epoxy results in a measured thermal conductivity of 0.2 Watts/Meter-Kelvin across the joints. By using the P120 or K1100 conductive fibers in accordance with the method of the present invention, a substantial improvement in thermal conductivity is achieved over prior art techniques.

Another advantage of the present invention is that during the operation of ships and aircraft during extreme weather conditions, the EMI shielding method and apparatus 20 of the present invention will continuously provide a compliant electrically conductive joint design due to the redundancy of the interdigitated sets of conductive fibers 34 and 42 respectively. Furthermore, it should be appreciated that electrical conductivity is maintained even if cracks develop throughout the polymer filler 40.

Figure 9:
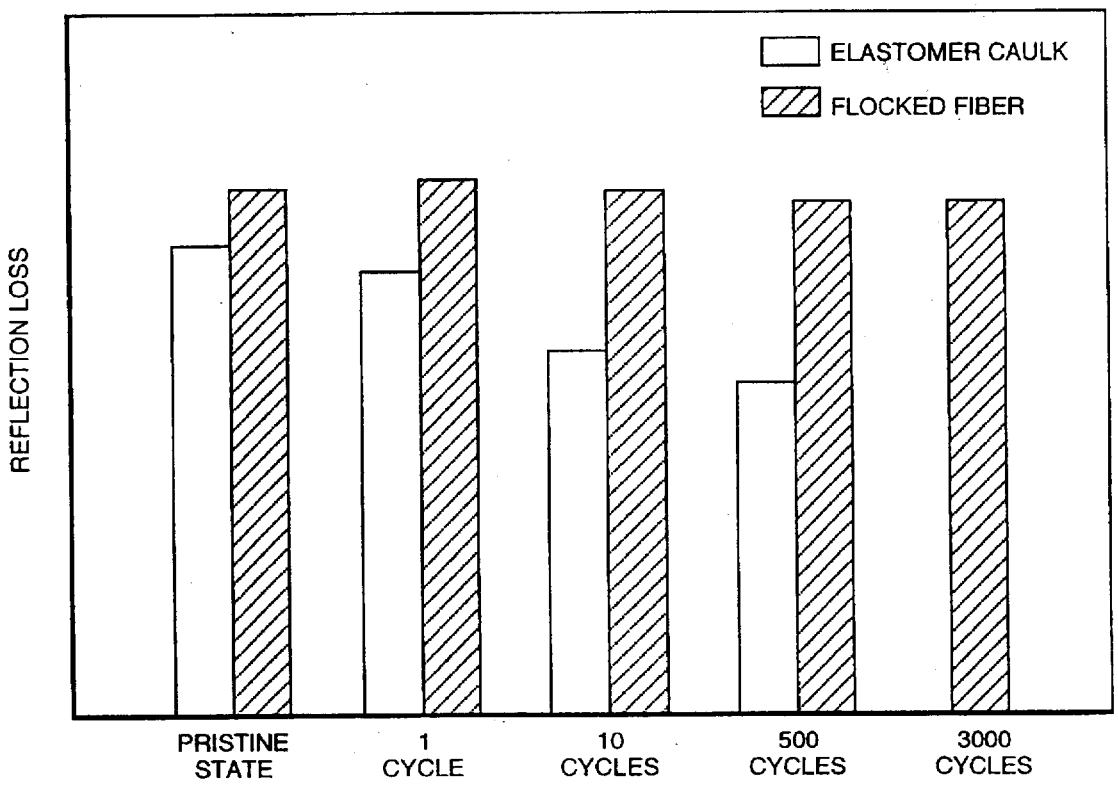
FIG. 9 is a table illustrating the improvement in reflection loss characteristics by use of the method and apparatus of the present invention over prior art techniques.

As with shielding components from electromagnetic interference, low observable vehicles require conductive, compliant gap materials to achieve desired radar cross-section characteristics. The present invention has additionally demonstrated its application to manufacturing fatigue resistant conductive joints for low observable application. Referring now to the measured test data shown in FIG. 9, the prior art technique of filling a structural butt joint with metal filled elastomer caulk produces moderately adequate reflection loss characteristics which degrade during the course of applied mechanical fatigue (±10% strain). However, in accordance with the method of the present invention, the flocked fiber filled gaps demonstrate superior reflection loss characteristics in the pristine state and do not exhibit degradation due to fatigue.

There has been described and illustrated herein an improved conductive gap method and apparatus utilizing fiber flocking technology. While particular embodiments of the invention have been described, it is not intended that the invention be limited exactly thereto, as it is intended that the invention be as broad in scope as the art will permit. The foregoing description and drawings will suggest other embodiments and variations within the scope of the claims to those skilled in the art, all of which are intended to be included in the spirit of the invention as herein set forth.

What is claimed is:

1. A method of achieving conductivity between a first surface edge and a second surface edge of a structural joint comprising the steps of:

(a) mounting a first set of conductive fibers to extend outwardly normal from the first surface edge of the structural joint by use of electrostatic flocking;

(b) mounting a second set of conductive fibers to extend outwardly normal from the second surface edge of the structural joint by use of electrostatic flocking;

(c) positioning said first and second sets of conductive fibers located on the first and second surface edges of the structural joint such that said first and second sets of conductive fibers interdigitate with respect to each other wherein said first and second sets of conductive fibers produce an overall electrical conductivity sufficient to simulate a constant conducting surface across the structural joint, whereby an electromagnetic seal is formed across the structural joint which improves the electrical conductivity, reduces the susceptibility to mechanical and thermal fatigue failures associated with structural joints and is highly corrosion resistant in use.

2. A method according to claim 1, wherein said first and second sets of conductive fibers are carbon fibers.

3. A method according to claim 2, wherein said carbon fibers are pitch based and have an electrical resistivity of approximately 2.2 ohm-cm$\times 10^{-4}$.

4. A method according to claim 2, wherein said carbon fibers are pitch based and have an electrical resistivity of 1.1–1.3 ohm-cm$\times 10^{-4}$.

5. A method according to claim 1, wherein after positioning said first and second sets of conductive fibers to interdigitate with respect to each other, a polymer filler is added between the first and second surface edges of the structural joint and within said first and second sets of conductive fibers.

6. A method according to claim 5, wherein said polymer filler is selected from the group consisting of silicon, polythioether or urethane.

7. A method according to claim 5, wherein the interdigitated fibers and polymer filler is removable and flexible.

8. A method according to claim 1, wherein the first and second surface edges are coated with a high-tack adhesive before said mounting said first and second sets of conductive fibers by said electrostatic flocking.

9. A method according to claim 8, wherein said high-tack adhesive being electrically conductive.

10. A method according to claim 1, wherein in said interdigitated position said first and second sets of conductive fibers have a 60 mil overlap across a 100 mil gap defined between the first and second surface edges of the structural joint.

11. A method according to claim 1, wherein said first and second sets of conductive fibers define a length having an aspect ratio of greater than 100.

12. A method according to claim 1, wherein the electrical conductivity across the structural joint being sufficient to prevent leakage of external electromagnetic fields.

13. A method according to claim 1, wherein the electrical conductivity across the structural joint being sufficient to prevent backscatter from electrical discontinuities.

14. A method of achieving conductivity between a first and second surface edge of a structural joint comprising the steps of:

(a) coating the first and second surface edges with a high-tack adhesive;

(b) inserting a first set and second set of conductive fibers by use of electrostatic flocking into said high-tack adhesive in a position normal to the first and second surfaces of the structural joint; and (c) positioning said first and second sets of conductive fibers located on the first and second surface edges of the structural joint such that said first and second sets of conductive fibers interdigitate with respect to each other wherein said first and second sets of conductive fibers produce an overall electrical conductivity sufficient to simulate a constant conducting surface across the structural joint, whereby an electromagnetic seal is formed across the structural joint which improves the electrical conductivity, reduces the susceptibility to mechanical and thermal fatigue failures associated with structural joints and is highly corrosion resistant in use.

15. A method according to claim 14, wherein said first and second sets of conductive fibers are carbon fibers.

16. A method according to claim 15, wherein said carbon fibers are pitch based and have an electrical resistivity of approximately 2.2 ohm-cm$\times 10^{-4}$.

17. A method according to claim 15, wherein said carbon fibers are pitch based and have an electrical resistivity of 1.1–1.3 ohm-cm$\times 10^{-4}$.

18. A method according to claim 14, wherein after positioning said first and second sets of conductive fibers to interdigitate with respect to each other a polymer filler is added between the first and second surface edges of the structural joint and within said first and second sets of conductive fibers.

19. A method according to claim 18, wherein said polymer filler is selected from the group consisting of silicon, polythioether or urethane.

20. A method according to claim 18, wherein the interdigitated fibers and polymer filler is removable and flexible.

21. A method according to claim 18, wherein said high-tack adhesive being electrically conductive.

22. A method according to claim 14, wherein in said interdigitated position said first and second sets of conductive fibers have a 60 mil overlap across a 100 mil gap defined between the first and second surface edges of the structural joint.

23. A method according to claim 14, wherein said first and second sets of conductive fibers define a length having an aspect ratio of greater than 100.

24. A method according to claim 14, wherein the electrical conductivity across the structural joint being sufficient to prevent leakage of external electromagnetic fields.

25. A method according to claim 14, wherein the electrical conductivity across the structural joint being sufficient to prevent backscatter from electrical discontinuities.

26. A method of achieving conductivity between a first and second surface edge of a structural joint comprising the steps of:

(a) coating the first and second surface edges with a high-rock adhesive being electrically conductive;

(b) inserting a first set and second set of carbon fibers by use of electrostatic flocking into said high-tack adhesive in a position normal to the first and second surfaces of the structural joint; and (c) positioning said first and second sets of carbon fibers located on the first and second surface edges of the structural joint such that said first and second sets of conductive fibers interdigitate with respect to each other wherein said first and second sets of conductive fibers produce an overall electrical conductivity sufficient to simulate a constant conducting surface across the structural joint and after positioning said first and second sets of conductive fibers to interdigitate with respect to each other a polymer filler is added between the first and second surface edges of the structural joint and within said first and second sets of conductive fibers, whereby an electromagnetic seal is formed across the structural joint which improves the electrical conductivity, reduces the susceptibility to mechanical and thermal fatigue failures associated with structural joints and is highly corrosion resistant in use.

27. A method according to claim 26, wherein the electrical conductivity across the structural joint being sufficient to prevent leakage of external electromagnetic fields.

28. A method according to claim 26, wherein the electrical conductivity across the structural joint being sufficient to prevent backscatter from electrical discontinuities.

* * * * *